United States Patent [19]

Sakayanagi et al.

[11] Patent Number: 4,720,639

[45] Date of Patent: Jan. 19, 1988

[54] SWITCH DEVICE FOR STARTER OF INTERNAL COMBUSTION ENGINE

[75] Inventors: Morikazu Sakayanagi, Toyohashi; Kazuhiro Ando, Kariya; Youichi Hasegawa, Kasugai, all of Japan

[73] Assignee: Nippondenso Co., Ltd., Kariya, Japan

[21] Appl. No.: 903,998

[22] Filed: Sep. 5, 1986

[30] Foreign Application Priority Data

Sep. 9, 1985 [JP] Japan ..... 60-199188
Jun. 17, 1986 [JP] Japan ..... 61-140905

[51] Int. Cl.[4] ..... F02N 11/00
[52] U.S. Cl. ..... 290/38 R
[58] Field of Search ..... 290/DIG. 1, 38 R, 38 C, 290/48; 310/209; 200/158, 38 E

[56] References Cited

U.S. PATENT DOCUMENTS 3,171,284 3/1965 Scherzinger ..... 74/7 R
4,418,289 11/1983 Mortensen ..... 290/DIG. 1
4,501,981 2/1985 Hansen ..... 310/209

FOREIGN PATENT DOCUMENTS 58-21104 4/1983 Japan .
1243920 8/1971 United Kingdom .
1564739 4/1980 United Kingdom .
2040000 8/1980 United Kingdom .

*Primary Examiner*—A. D. Pellinen
*Assistant Examiner*—Morris Ginsburg
*Attorney, Agent, or Firm*—Cushman, Darby & Cushman

[57] ABSTRACT

A starter switch device controls the application of an electric current from a power source to a starter motor and drives a pinion for transmitting the rotation of said starter motor to engage with a ring gear of an internal combustion engine. The starter switch device includes a shaft provided movably in the axial direction thereof, and open-close operation of electrical contacts for communicating the power source with the starter motor and also the driving of the pinion are carried out via the shaft. Further, there is provided a motor for driving this shaft, and the shaft and the motor are connected through a mechanism for transforming the rotation of the motor into the linear movement of the shaft.

10 Claims, 25 Drawing Figures

SWITCH DEVICE FOR STARTER OF INTERNAL COMBUSTION ENGINE

BACKGROUND OF THE INVENTION

The present invention relates to a switch device used in a starter for starting an internal combustion engine.

A conventional starter switch device includes a plunger axially movable and a solenoid for driving this plunger as seen, for example, in Japanese Patent Publication No. 21104/83. The plunger is disposed on the inner peripheral side of the solenoid. The plunger is provided at one end thereof with a movable contact which is adapted to abut on fixed contacts, and engages at the other end thereof with a lever which is adapted to thrust out a pinion toward the ring gear side of an internal combustion engine. In this arrangement, by the application of an electric current to the solenoid, the plunger moves in its axial direction. The thus axially moved plunger thrusts out the pinion while making the movable contact abut on the fixed contacts, so that an electric current is supplied to a starter motor and the pinion is engaged with the ring gear to start the internal combustion engine.

According to such a conventional arrangement as described above, however, the solenoid requires a certain axial length since the plunger is axially moved to move the pinion to the ring gear side by means of an attracting force of the solenoid. Inevitably, the switch device is increased in axial size. Further, the plunger receiving magnetic flux of the solenoid requires a certain cross-sectional area in order to obtain a necessary attracting force, so that there exist a problem that the switch device is also radially increased in size.

SUMMARY OF THE INVENTION

An object of the invention is to provide a switch device for a starter of an internal combustion engine, which may be reduced in overall size in view of the above-described problem of the prior art.

According to the invention, there is provided a starter switch device for controlling application of an electric current from a power source to a starter motor and engaging a pinion with a ring gear of an internal combustion engine, rotation of the starter motor being transmitted to the pinion, the starter switch device comprising: fixed contact means; shaft means arranged movably in an axial direction thereof for displacement of the pinion toward the ring gear side, the shaft means being provided at one end thereof with movable contact means for abutting on the fixed contact means to apply an electric current from the power source to the starter motor; and, driving means including a rotating shaft engaging with the shaft means for moving the same axially by rotation of the rotating shaft.

The above object and features of the invention as well as other objects, features and advantages will become more apparent from the detailed description on the preferred embodiments of the invention which will be made hereinafter with reference to the accompanying drawings.

Figure 8:
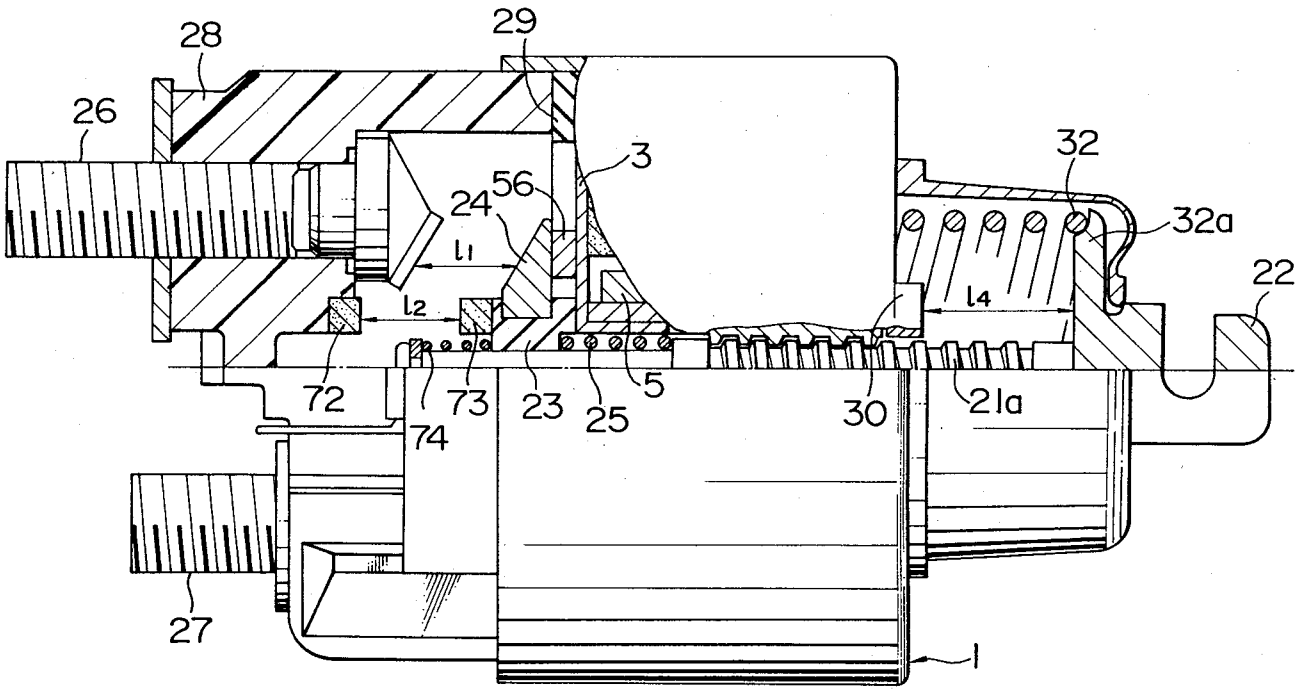
Figure 9:
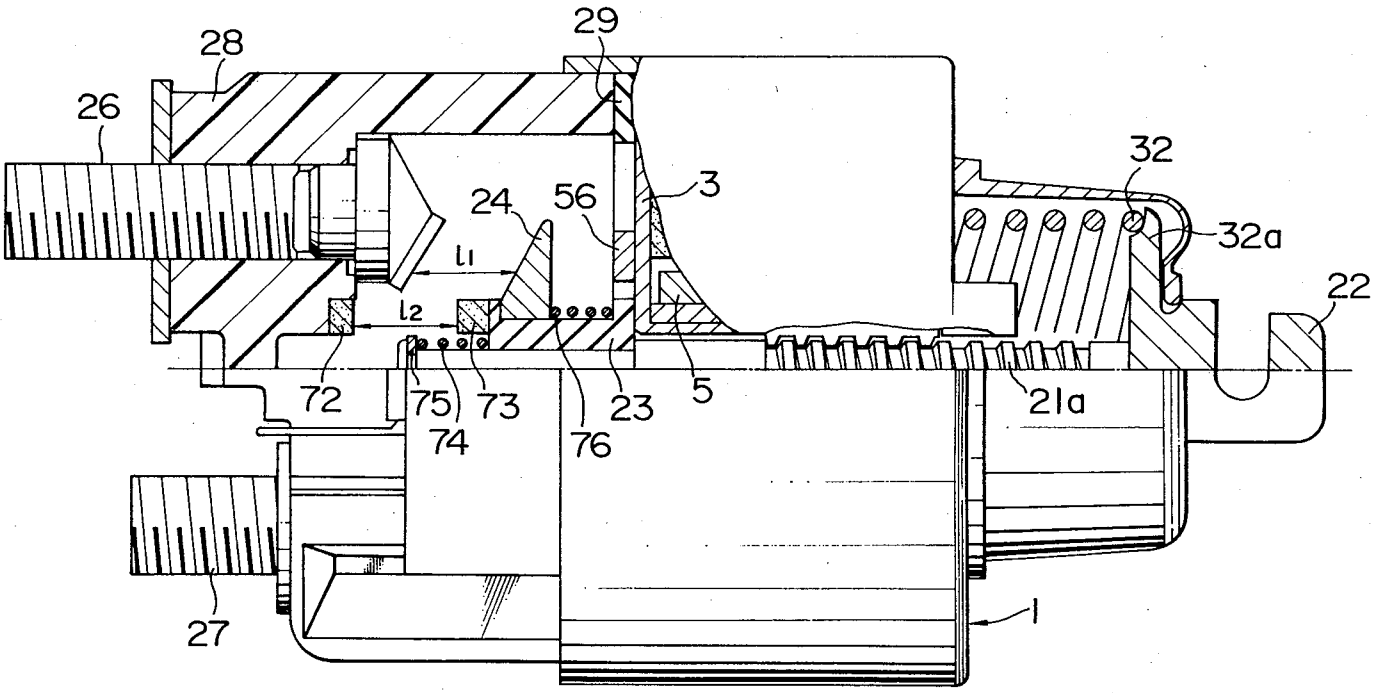
Figure 10:
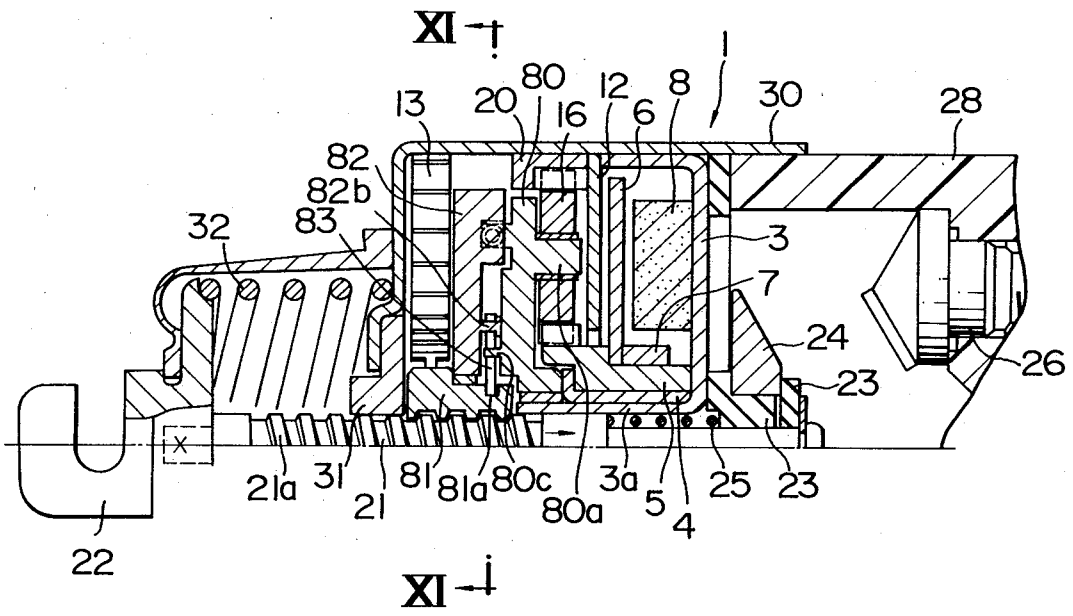
Figure 11A:
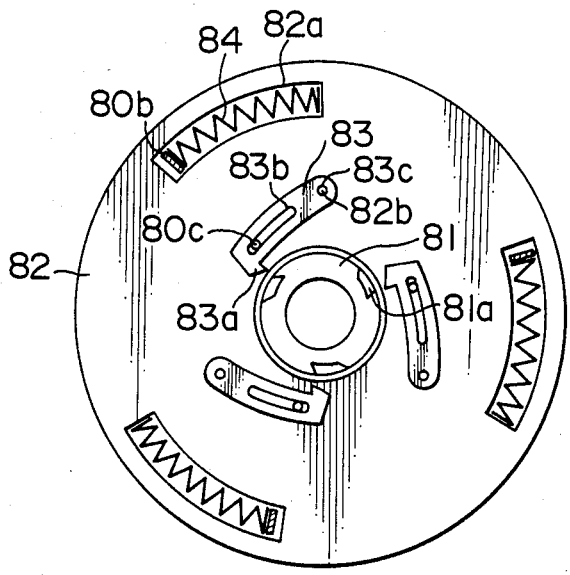
Figure 11B:
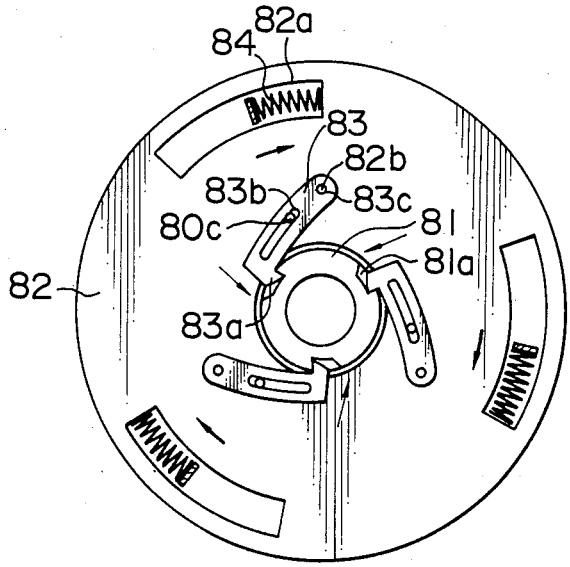
Figure 12:
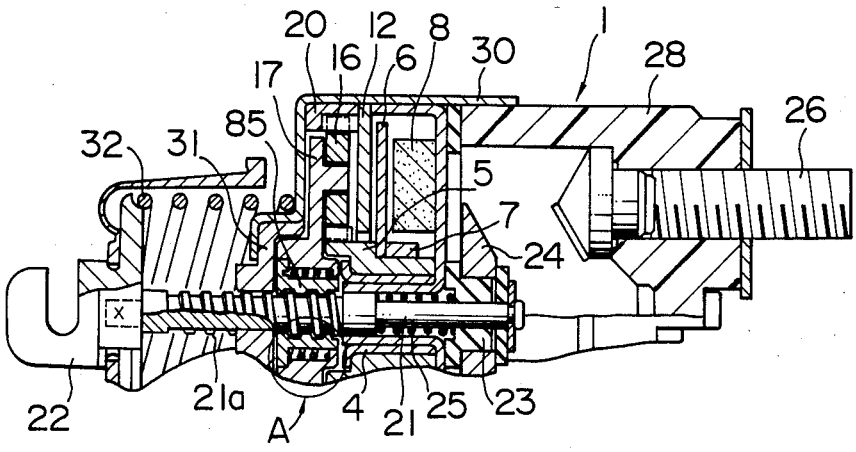
Figure 14:
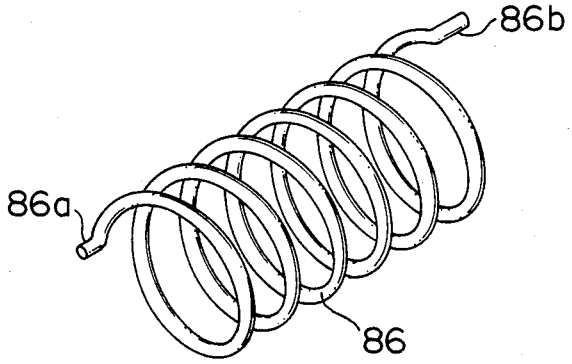
Figure 13A:
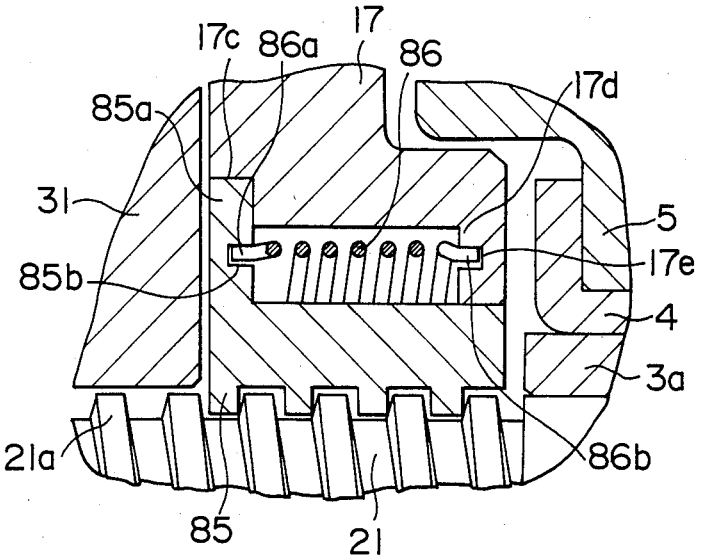
Figure 13B:
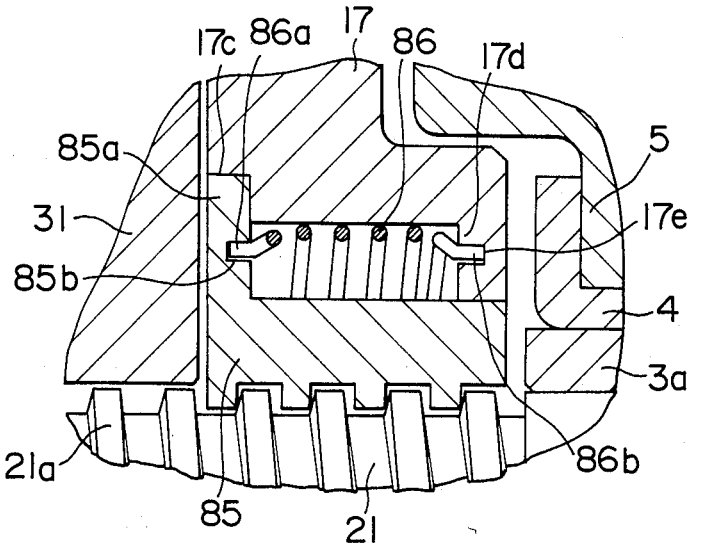
Figure 15:
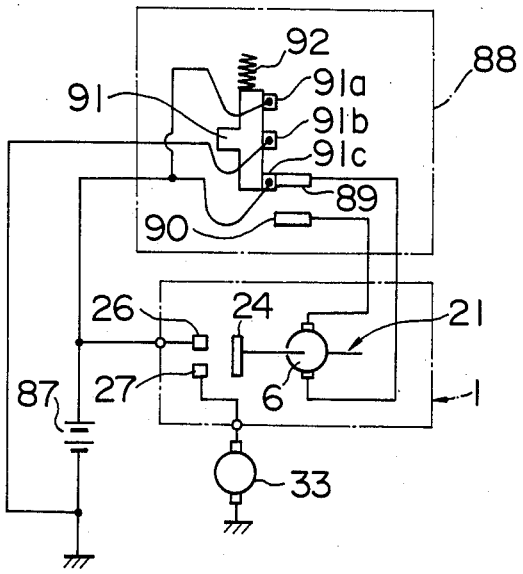
Figure 16:
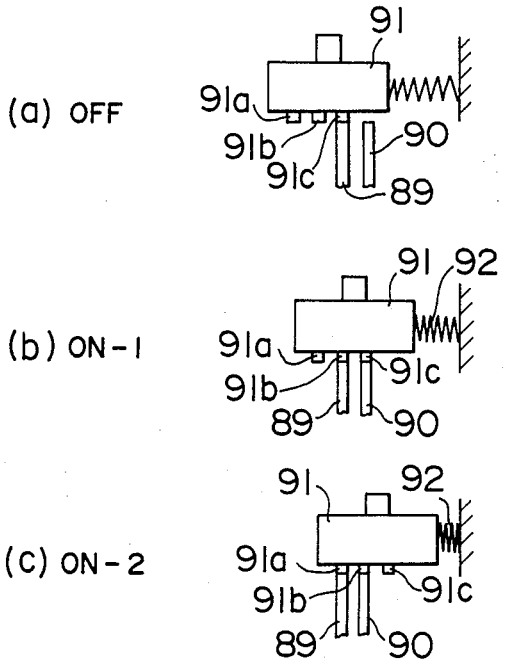
Figure 17:
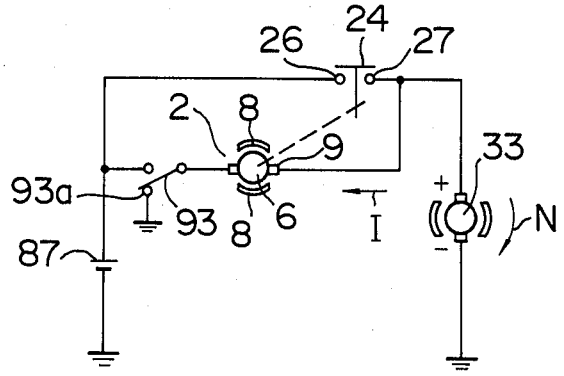
Figure 18:
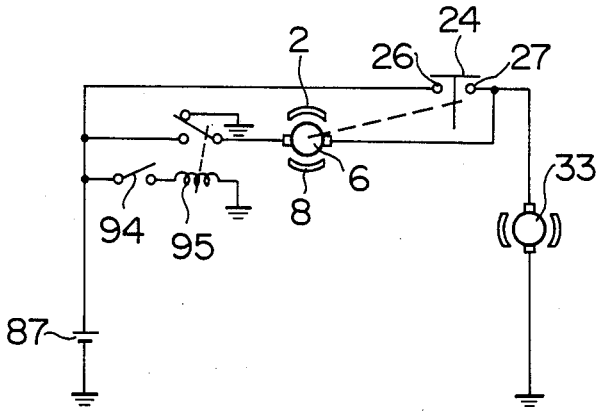
Figure 19:
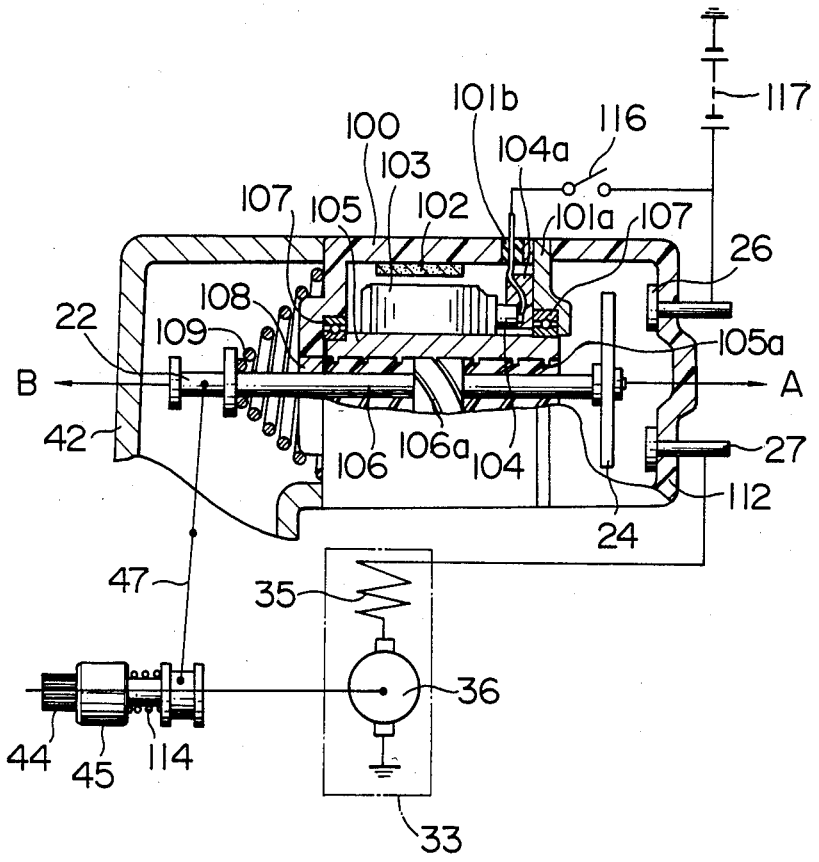
Figure 20:
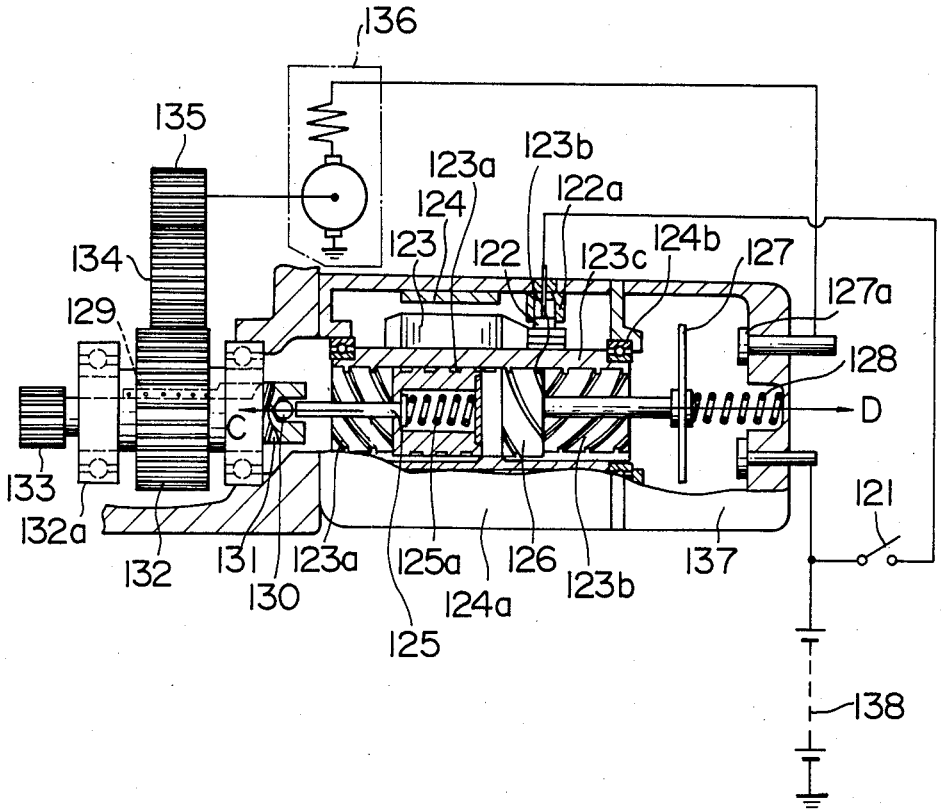
Figure 21:
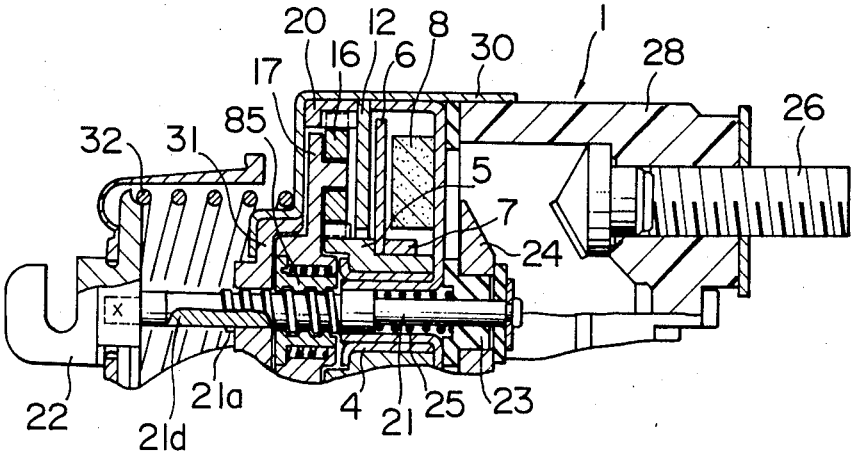
Figure 22:
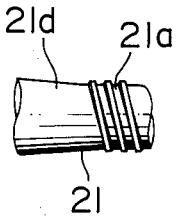

FIG. *7a* is a side view of a starter switch device according to a third embodiment of the present invention, showing the half portion of the switch device in cross section;

FIG. *7b* is a cross-sectional view showing an essential portion of the third embodiment of FIG. *7a* in the operating condition;

FIG. 8 is a side view showing a starter switch device according to a fourth embodiment of the present invention with an essential portion of the switch device cross-sectioned;

FIG. 9 is a side view showing a starter switch device according to a fifth embodiment of the present invention with an essential portion of the switch device cross-sectioned;

FIG. 10 is a cross-sectional view of an essential portion of a starter switch device according to a sixth embodiment of the present invention;

FIGS. 11*a* and 11*b* are cross-sectional views taken along the line XI—XI of FIG. 10, illustrating the non-operative and operating conditions of the switch device, respectively;

FIG. 12 is a cross-sectional view of an essential portion of a starter switch device according to a seventh embodiment of the present invention;

FIGS. 13*a* and 13*b* are both enlarged views of a portion indicated by A in FIG. 12, illustrating different operating conditions of the switch device, respectively;

FIG. 14 is a perspective view of a spring used in the embodiment of FIG. 12;

FIG. 15 is an electric circuit diagram of a starter incorporated with a switch device according to an eighth embodiment of the present invention;

FIG. 16 is an explanatory view showing the operating condition of a key switch used in the embodiment of FIG. 15;

FIG. 17 is an electric circuit diagram of a starter employing a switch device according to a ninth embodiment of the present invention;

FIG. 18 is an electric circuit diagram of a starter using a switch device according to a tenth embodiment of the present invention;

FIG. 19 is an explanatory view showing the arrangements of a starter incorporated with a switch device according to an eleventh embodiment of the present invention;

FIG. 20 is an explanatory view showing the arrangements of a starter including a switch device according to a twelfth embodiment of the present invention;

FIG. 21 is a cross-sectional view of an essential portion of a starter switch device according to a thirteenth embodiment of the present invention; and FIG. 22 is a side view showing an essential portion of a shaft installed in the embodiment of FIG. 21.

DETAILED DESCRIPTION OF PREFERRED EMBODIMENTS

The present invention will be described hereinafter in conjunction with preferred embodiments shown in the drawings.

Figure 1:
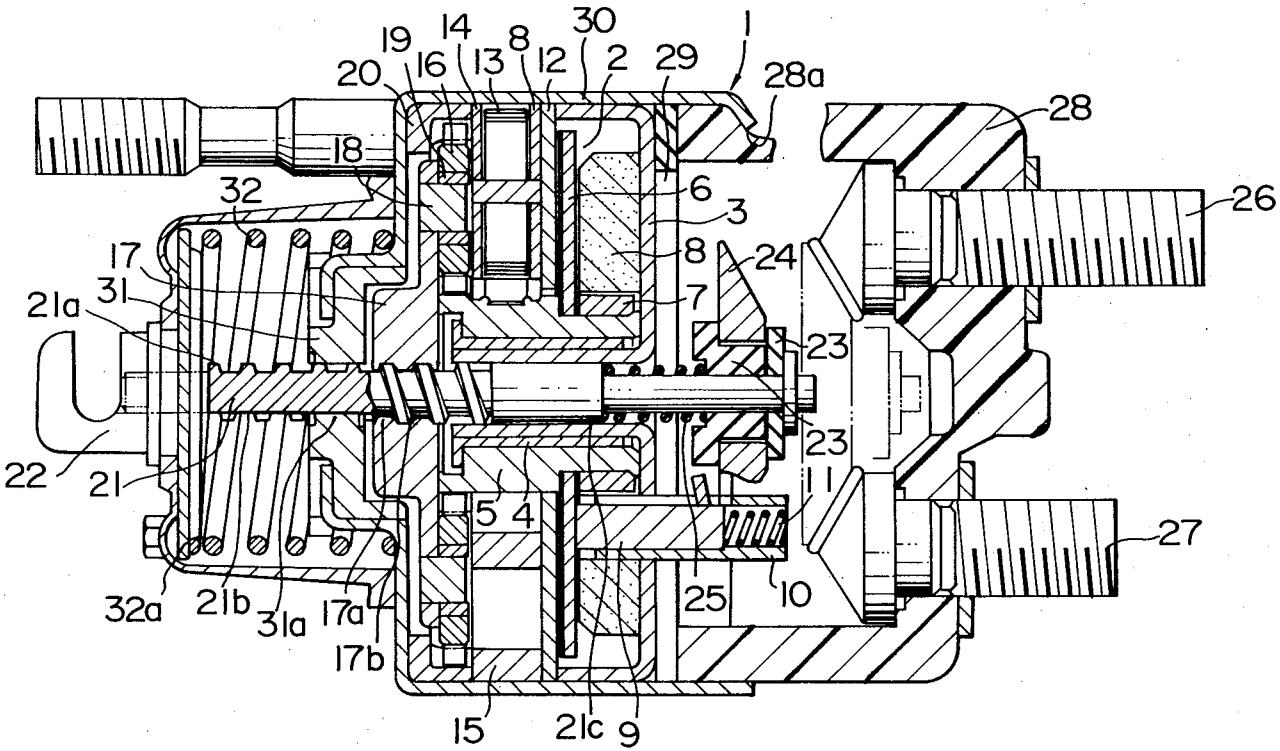
FIG. 1 is a cross-sectional view of a starter switch device according to a first embodiment of the present invention.
Figure 2:
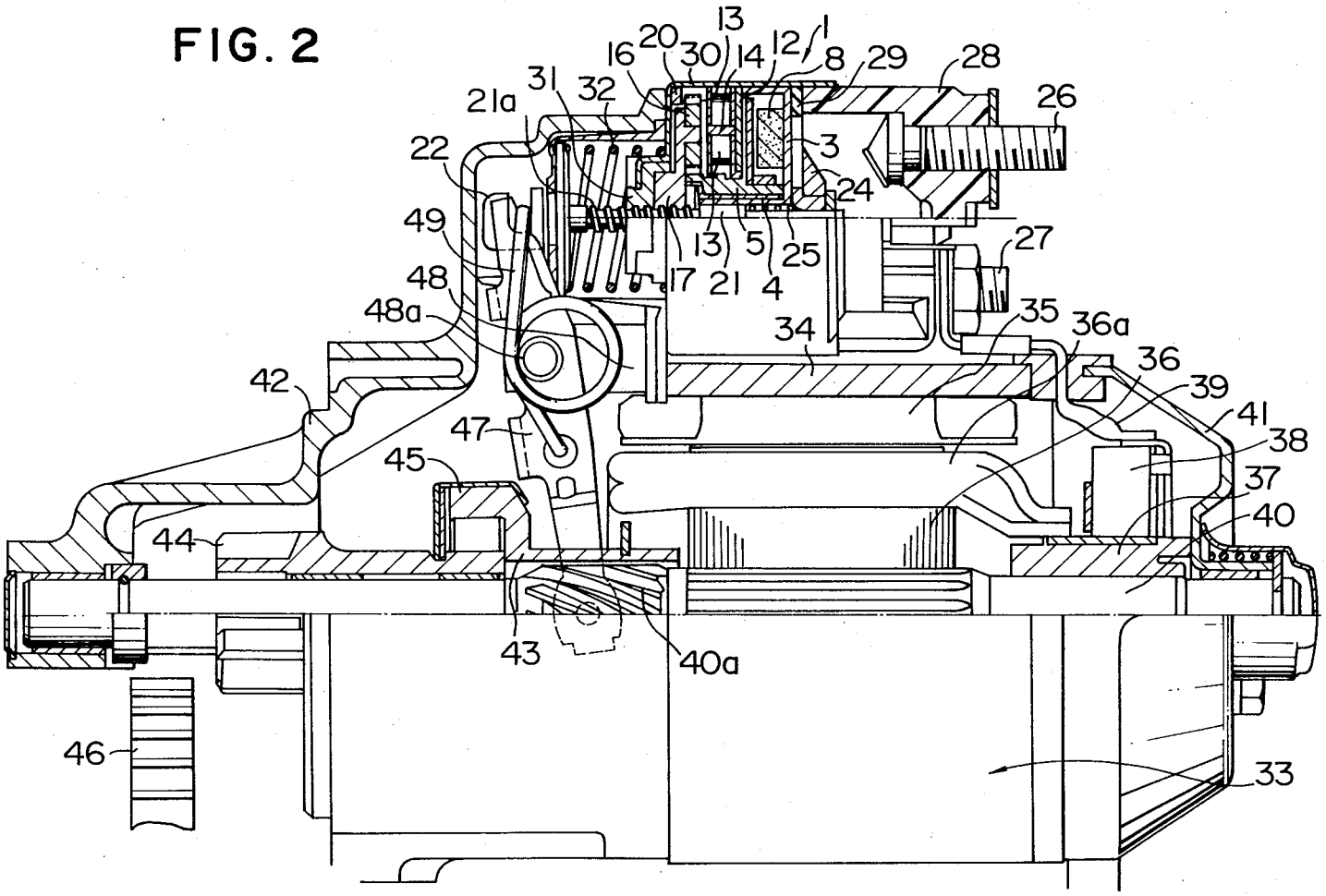
FIG. 2 is a cross-sectional view of an essential portion of a starter incorporated with the switch device shown in FIG. 1.

FIG. 1 shows a cross-sectional view of a switch device for a starter according to a first embodiment of the invention, and FIG. 2 shows a cross-sectional view of an essential portion of the starter which is incorporated with the switch device of FIG. 1.

Figure 3:
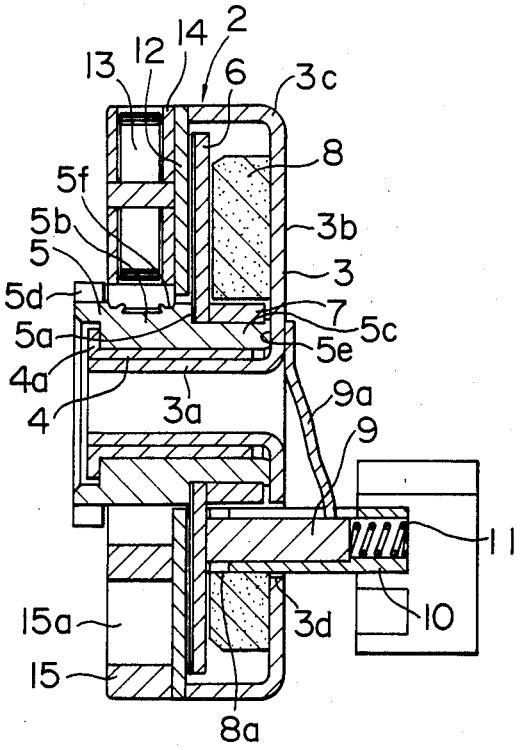
FIG. 3 is a cross-sectional view of a print motor used in the embodiment of FIG. 1.

In FIGS. 1 and 2, reference numeral 1 generally designates the switch device in which a print motor 2 of a flat motor type is provided. As shown in detail in FIG. 3, a first yoke 3 of the print motor 2 comprises a first tube-like portion 3*a*, a disc portion 3*b* bended radially outwardly from the end of the first tube-like portion 3*a*, and a second tube-like portion 3*c* bended from the outer peripheral end of the disc portion 3*b* to be opposite to the first tube-like portion 3*a*. A second disc-like yoke 12 is located at the end of the second tube-like portion 3*c* of the first yoke 3 so as to be opposite to the disc portion 3*b*. Also, via a bearing 4 which has a collar portion 4*a* at one end thereof, a rotating shaft 5 is rotatably located on the outer periphery of the first tube-like portion 3*a* between the collar portion 4*a* and the disc portion 3*b*. A stepped portion 5*a* is provided in the outer periphery of this rotating shaft 5 to define a large diameter portion 5*b* and a small diameter portion 5*c*. A sun gear 5*d* is provided in an outer periphery of the outer end of the large diameter portion 5*b*.

Figure 4:
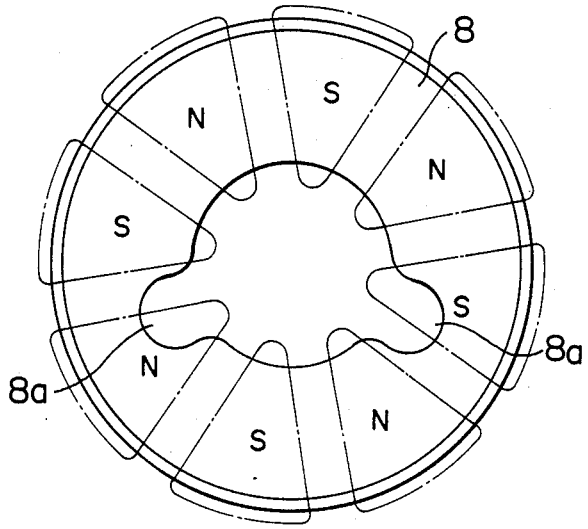
FIG. 4 is a diagramatical view showing magnets used in the embodiment of FIG. 1.

An armature 6 made of a printed board is disposed on an outer periphery of the small diameter portion 5*c* of the rotating shaft 5. The armature 6 is biased against the stepped portion 5*a* through a spacer 7 to be secured to the rotating shaft 5 by calking an end surface 5*e* of the small diameter portion 5*e*. A magnet 8 is secured to the disc portion 3*b* of the yoke 3 by such means as an adhesive at a position opposite to the armature 6. The magnet 8 is in a ring-like shape as shown in FIG. 4, and is adapted to be magnetized alternately circumferentially. Also, two semicircular notch portions 8*a*,8*a* are formed at the inner peripheral side of the magnet 8 to permit brushes 9 for supplying current to the armature 6 to pass through. Moreover, magnetic flux of the magnet 8 passes the armature 6 and returns to the magnet 8 through the second yoke 12, the second tube-like portion 3*c* and the disc portion 3*b* of the first yoke 3.

Reference numeral 10 indicates brush holders for retainment of brushes, and these brush holders are located to extend through a hole 3*d* of the disc portion 3*b* of the yoke 3 and the notch portions 8*a* of the magnet 8. The brush holders 10,10 also project within a contact cover 28 as shown in FIG. 1. A pigtail (not shown) on the plus side of each brush 9 is connected to an outer terminal, and pigtails 9*a* on the minus sides are connected to the disc portion 3*b* of the yoke 3 to be grounded. Further, reference numeral 11 shows one of a brush spring.

Figure 5:
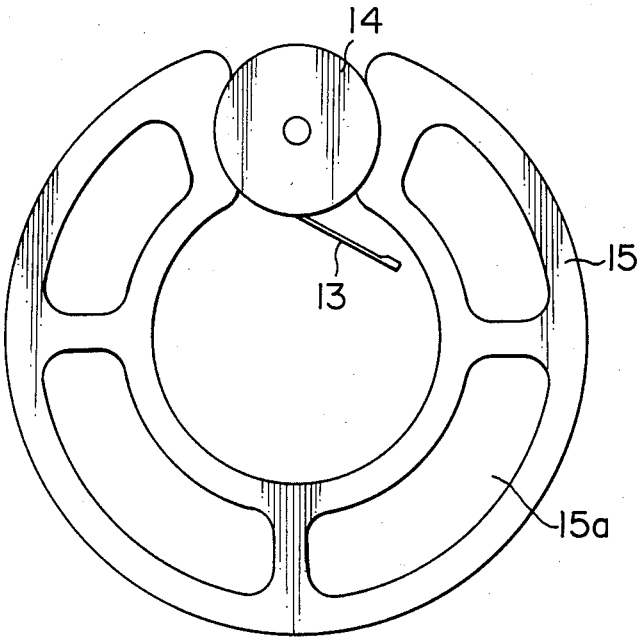
FIG. 5 is a front view of a power spring and a frame employed in the embodiment of FIG. 1.

A power spring 13 woundly installed in a bobbin 14 is mounted on the print motor 2. The power spring 13 is secured at its one end to the bobbin 14, and is fixed at the other end thereof to an outer periphery of the large diameter portion 5*b* of the rotating shaft 5 through a caulking part 5*f*. Moreover, the bobbin 14 is supported by a frame 15 and is generally in an annular form, as shown in FIG. 5. Windows 15*a* are formed in the frame 15 to decrease the weight of the frame.

A plurality of planet gears 16 for engaging with the sun gear 5*d* of the rotating shaft 5 are located in the circumferential direction around the sun gear. Each of these planet gears is rotatably supported via a bearing 19 by a pin 18 which is secured to a rotating body 17. An opening portion 17*b* is formed in the rotating body 17 to allow a shaft 21 passing therethrough, and a spiral internal screw section 17*a* is formed in the opening portion 17*b* to serve as a gear. Further, an annular internal gear 20 is disposed at the outer peripheral side of the planet gears 16 to engage with these planet gears. Thus, a speed reducing gear train is constituted with the sun gear 5*d*, the planet gears 16 and the internal gear 20.

The shaft 21 is located axially movably in the first tube-like portion 3*a* of the first yoke 3. A U-shaped hook part 22 is provided on one end of this shaft, and a rectangular movable contact 24 is provided slidably on the other end of the shaft through an interposed isolator 23. The shaft 21 is formed in an outer periphery thereof on the side of the hook part 22 with a spiral screw portion 21*a* for engagement with the internal screw section 17*a* of the rotating body 17. Also, there is formed at a circumferential portion of the outer periphery of the shaft 21 on the side of the hook part 22 with a concave part 21*b* which extends axially across the screw portion 21*a*. Further, a stepped portion 21*c* is provided at a middle part of the shaft 21, and a contact pressure spring 25 is interposed between this stepped portion 21*c* and the isolator 23 so as to bias the latter.

A pair of fixed contacts 26,27 are disposed at positions where they abut on the movable contact 24, and fixedly secured to a contact cover 28 made of a resin.

Reference numeral 30 designates a switch cover, to one end of which a ring-like bearing 31 is attached. The bearing 31 supports the outer periphery of the screw portion 21*a* of the shaft 21, and has projection 31*a* fitted in the concave part 21*b* of the shaft 21. Thus, the shaft 21 is movable axially but unable to move in a rotational direction. There are contained within the switch cover 30 the internal gear 20, the frame 15 installed with the bobbin 14, and the print motor 2. By attaching the contact cover 28 to the switch cover 30 via an isolating board 29 and tightly squeezing the other end of the switch cover 30 around the concave portion 28*a* of the contact cover 28, the internal gear 20, the frame 15 and the print motor 2 are secured within the switch cover 30. A return spring 32 is suspendedly mounted between a plate 32*a* provided on the shaft 21 and the outer periphery of the switch cover 30.

In FIG. 2, reference numeral 33, generally indicates a starter motor, in which a field magnet 35 is fixed on the inner periphery of a yoke 34 of the starter motor 33, and an armature 36 is disposed on the inner side of the field magnet 35. An armature coil 36*a* of the armature 36 is electrically connected to a commutator 37, on which brushes 38 are slidably disposed. These brushes 38 are connected to the fixed contacts 27 of the switch device 1 through a connecting wire 39. The switch device 1 is mounted on the yoke 34 to be secured to the starter motor 33. An armature shaft 40 of the armature 36 is rotatably supported at its one end by an end frame 41 and at the other end by a starter housing 42 via bearings, respectively. Helical splines 40*a* are formed in an intermediate outer periphery of the armature shaft 40, and a spline tube 43 which is spline-engaged with the helical splines 40*a* is disposed on the shaft 40. A pinion 44 is rotatably mounted on the armature shaft 40 through bearings at a position adjacent the helical splines 40*a*, and is coupled with the spline tube 43 through a one-way clutch 45. Reference numeral 46 denotes a ring gear on the part of an internal combustion engine, and the ring gear is adapted to be engaged with the pinion 44.

A lever 47 is disposed above the spline tube 43. One end of this lever is engaged with the hook part 22 on the shaft 21 of the magnet switch device 1 and the other end of the lever is engaged with the outer periphery of the spline tube 43 such that the tube can rotate. The lever 47 is rotatable about a fulcrum 48*a* of a lever holder 48. Reference numeral 49 designates a drive spring.

The operation of the embodiment constituted as above will be described hereinafter. When a starter switch (not shown) is turned ON to apply a voltage to the brushes 9 of the switch device 1, an electric current flows through the armature 6 for rotation of the same together with the rotating shaft 5 on the bearing 4 by means of the magnetic flux of the magnet 8. The rotation of the rotating shaft 5 is reduced in speed through the sun gear 5*d* and the planet gears 16, and transmitted to the rotating body 17. Simultaneously, although the shaft 21 engaging with the screw section 17*a* of the rotating body 17 tends to rotate together with the rotating body 17, it cannot rotate with restraint by the projection 31*a* of the bearing 31 so as to move axially rightwardly in FIG. 1.

Then, as the shaft 21 moves toward the fixed contacts 26 and 27, the one end of the lever 47 is pulled by the hook part 22. Accordingly, the lever 47 rotatingly moves about the fulcrum 48*a* of the lever holder 48 in the clockwise direction in FIG. 2, and thrusts out the spline tube 43 for movement of the one-way clutch 45 as well as the pinion 44 toward the ring gear 46.

The pinion 44 which is thrusted forwardly (to the left in FIG. 2) engages with the ring gear 46 connected to a crankshaft of the engine (not shown). The pinion is further advanced after abutment on the ring gear 46. At the point that the pinion 44 and the ring gear 46 are meshed with each other sufficiently, the movable contact 24 is brought into abutting engagement with the fixed contact 26 and 27 to form a circuit from a battery (not shown) connected to the one fixed contact 26 to the other fixed contact 27. Thus, an electric current flows to the brushes 38 of the starter motor 33 so that the armature shaft 40 is rotated together with the armature 36. The rotation of the armature shaft 40 is transmitted to the spline tube 43 through the helical splines 40*a*, and further to the pinion 44 through the one-way clutch 45. As a result, the pinion 44 rotatingly drives the ring gear 46 and make the internal combustion engine start.

Further, as the rotating shaft 5 of the print motor 2 rotates, the power spring 13 secured at its one end to the rotating shaft 5 is wound around the outer periphery of the rotating shaft 5. Thus, an energy which acts to rotate the rotating shaft 5 reversely to the current rotating direction thereof is stored in the power spring.

When the starter switch is turned OFF succeedingly to the start of the internal combustion engine, the electric power being supplied to the print motor 2 is shut off and the rotating shaft 5 also stops rotating. Then, the energy (spring force) generated by the power spring 13 returning to the initial state thereof rotates the rotating shaft 5 connected with the power spring 13 in the rotational direction reverse to that by the print motor 2. When the rotating shaft 5 is rotated reversely, the shaft 21 is moved in the direction away from the fixed contacts 26 and 27 (to the left in the figure). The movable contact 24 breaks contact with the fixed contacts 26 and 27 to intercept an electric power to the starter motor 33 for stopping the rotating of the armature 36. At the same time, the spline tube 43 is returned to its original position by the pivotal movement of the lever 47, so that the pinion 44 is disengaged with the ring gear 46. Furthermore, during the above-described returning operation, a force of the return spring 32 acts on the shaft 21 in addition to the force of the power spring 13, and the shaft 21 returns to the initial position thereof rapidly.

According to the above-described embodiment, the following advantages and effects will be obtained.

(1) The switch device is so arranged that the print motor 2 and the planet gears 16 of the speed reducing gear train are disposed coaxially on the shaft 21 and that the rotation of the rotating shaft 5 of the print motor 2 is reduced in speed through the speed reducing gear train for movement of the shaft 21 in the axial direction thereof. Accordingly, the total of the axial thickness of the print motor and the axial extension of the speed reducing gear train substantially corresponds to almost the whole length of the switch device, whereby the switch device 1 can be reduced in length as well as in weight.

(2) It is sufficient for the shaft 21 to have a strength necessary for pulling the lever 47. Therefore, while the plunger of a conventional device requires a larger cross-sectional area than a prescribed area so as to use sufficient magnetic flux of a solenoid, a shaft of a very small diameter can be employed in the device according to the preset invention. Consequently, it is possible to reduce the switch device 1 also in its diametrical size.

(3) The space within the contact cover 28 is effectively made use of for the positioning of the feeding brushes 9 for the armature 6 of the print motor 2. Accordingly, the device is prevented from increasing in the axial length owing to the provision of the brushes 9.

(4) Since the planet gear mechanism is used for the speed reducing gear train, the print motor 2 and the planet gears 16 can be located coaxially and driving force from the rotating shaft 5 of the print motor 2 disposed in close vicinity to the shaft 21 can readily be transmitted to the shaft 21 through the planet gears 16. It is not necessary, therefore, to provide a complex mechanism for transmitting the driving force.

(5) The reducing mechanism (5*d*, 16, 20) is provided to gradually move the shaft 21 at a low speed for displacement of the pinion 44 through the lever 47. According to this arrangement, it is possible to avoid the occurrence of a problem that prior to the rotation of the lever 47, the drive spring 49 may yield and the movable contact 24 may come into contact with the fixed contacts 26 and 27 due to an abrupt motion of the shaft 21 so that the pinion 44 and the ring gear 46 do not engage with each other sufficiently.

Figure 6:
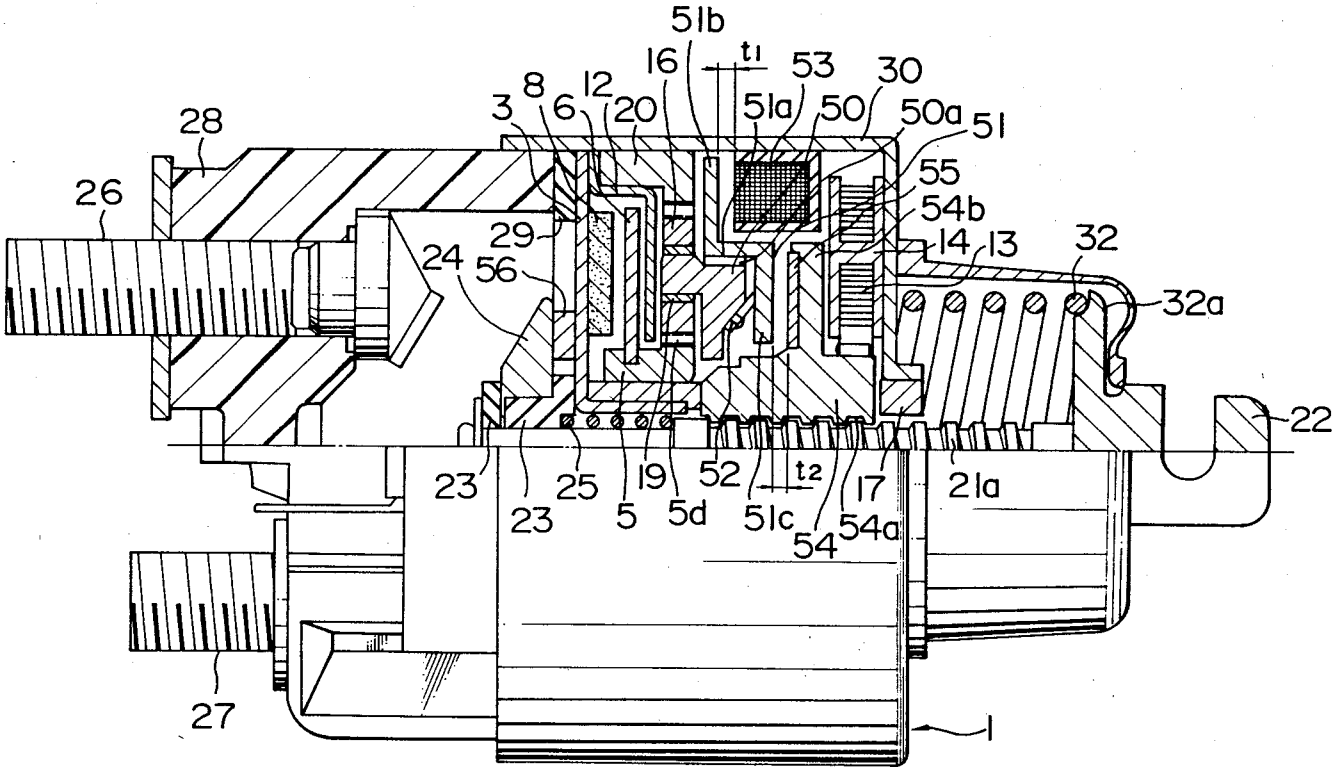
FIG. 6 is a side view of a starter switch device according to a second embodiment of the present invention showing the half portion of the switch device in cross section.

A switch device according to a second embodiment of the invention is shown in FIG. 6. In the description on the embodiment shown in FIG. 6 and still other embodiments which will be described hereinafter, the detailed description of similar components to those used in the first embodiment will be omitted by using the same reference numerals as those used in FIG. 1. In the second embodiment, a rotating body 50 located around a shaft 21 carries planet gears 16 rotatably via bearings 19, and a linear spline portion 50*a* is formed on the outer periphery of the rotating body. Reference numeral 51 designates a movable disc of a magnetic material. The movable disc 51 includes a tube-like portion 51*a* engaging through splines with the linear spline portion 50*a* of the rotating body 50, a first disc portion 51*b* radially outwardly extending from one end of the tube-like portion 51*a* on the side of the planet gears 16, and a second disc portion 51*c* radially inwardly extending from the other end of the tube-like portion 51*a*. A leaf-shaped return spring 52 is interposed between the rotating body 50 and the movable disc 51. A coil 53 for generating electromagnetic force is located radially outwardly of the tube-like portion 51*a* of the movable disc 51 so as to confront the first disc portion 51*b*. The coil 53 is secured to the inner side of a switch cover 30 at a prescribed distance of $t_1$ from the first disc portion 51*b*.

Reference numeral 54 indicates a driving body for driving the shaft 21, and an inside screw portion 54*a* is formed in the driving body for engaging with an outer spiral screw portion 21*a* of the shaft 21. Additionally, a projection 54*b* is formed on the driving body 54 such as to extend radially outwardly to confront the second disc portion 51*c* of the movable disc 51, and a clutch plate 55 is attached to the projection 54*b*. The driving body 54 is mounted on the shaft 21 with the clutch plate 55 disposed at a predetermined distance $t_2$ ($t_1 > t_2$) from the second disc portion 51*c* of the movable disc 51.

Also, one end of a power spring 13 is secured to the outer periphery of the driving body 54 by such means as staking. A bobbin 14 for winding the power spring 13 is fixed to the side of the switch cover 30.

A movable contact 24 is made of copper, and a member 56 made of iron is attached to the back side of the movable contact by an adhesive or the like.

The operation of the second embodiment having the above-mentioned construction will be described hereinunder.

When a starter switch (not shown) is closed, an electric current is applied to the electromagnetic coil 53, and the coil 53 attracts the first disc portion 51*b* of the movable disc 51. Then the movable disc 51 axially slides on the rotating body 50 against the return spring 52, and the second disc portion 51*c* is brought into abutting engagement with the clutch plate 55 of the driving body 54. Therefore, the transmission of rotation from the movable disc 51 to the driving body 54 is made possible.

Simultaneously with the above application of the electric current to the electromagnetic coil 53, the electric current flows through an armature 6 from brushes (not shown, corresponding to the brushes 9 in FIG. 1) to rotate a rotating shaft 5. The rotation of the shaft 5 is reduced in speed through a sun gear 5*d* and the planet gears 16 to be transmitted to the rotating body 50. The rotating body 50 and the movable disc 51 are directly coupled with each other through the splines as mentioned above, so that the rotation of the rotating body 50 is transmitted to the shaft 21 through the movable disc 51 and the driving body 54.

Due to the rotation drive by the driving body 54, the shaft 21 moves axially for moving a pinion toward the ring gear of an internal combustion engine, as is in the first embodiment described above, and for bringing the movable contact 24 into contact with fixed contacts 26 and 27.

After the start of the internal combustion engine, when the electric current to a print motor 2 and the electromagnetic coil is shut off, the return spring 52 makes the movable disc 51 return toward the rotating body 50 and the transmission of rotation from the movable disc 51 to the driving body 54 is intercepted. Simultaneously, the power spring 13 wound during the rotation of the driving body 54 rotationally drives the driving body 54 to return the shaft 21 to the position as it was.

Thus, in the present embodiment, it is enough to have only the driving body 54 rotate by the power spring 13 when the shaft 21 is to be returned. Accordingly, the shaft 21 is returned rapidly so that the occurrence of an arc between the movable contact 24 and the fixed contacts 26, 27 can be reduced.

Further, during non-operation of the switch device 1, the magnetic member 56 fixed to the movable contact 24 is attracted toward the magnet 8 through a first yoke 3 by the magnetic force of the magnet 8, and a play of the movable contact 24 may be eliminated.

In the above-described embodiment, although the pinion 44 is moved to the ring gear 46 side of the internal combustion engine by through the pivotal motion of the lever 47, the shaft 21 and the pinion 44 may be arranged to be located coaxially so that the displacement of the shaft 21 directly drives the pinion 44.

Additionally, although there is provided a return spring 32 in the second embodiment described above, the return spring 32 may be eliminated if the shaft 21 is adapted to be returned only by the spring force of the power spring 13.

Furthermore, although the planet gears 16 are used for a speed reducing mechanism, two gears having different gear ratios may be coaxially provided within the switch cover 30 for reducing in speed the rotation transmitted from the print motor 2 to the shaft 21 by means of the differential between the gear ratios of these gears.

Figure 7B:
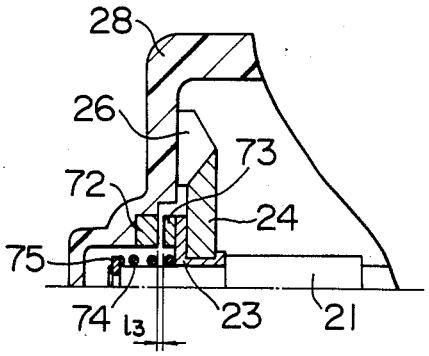
Figure 7A:
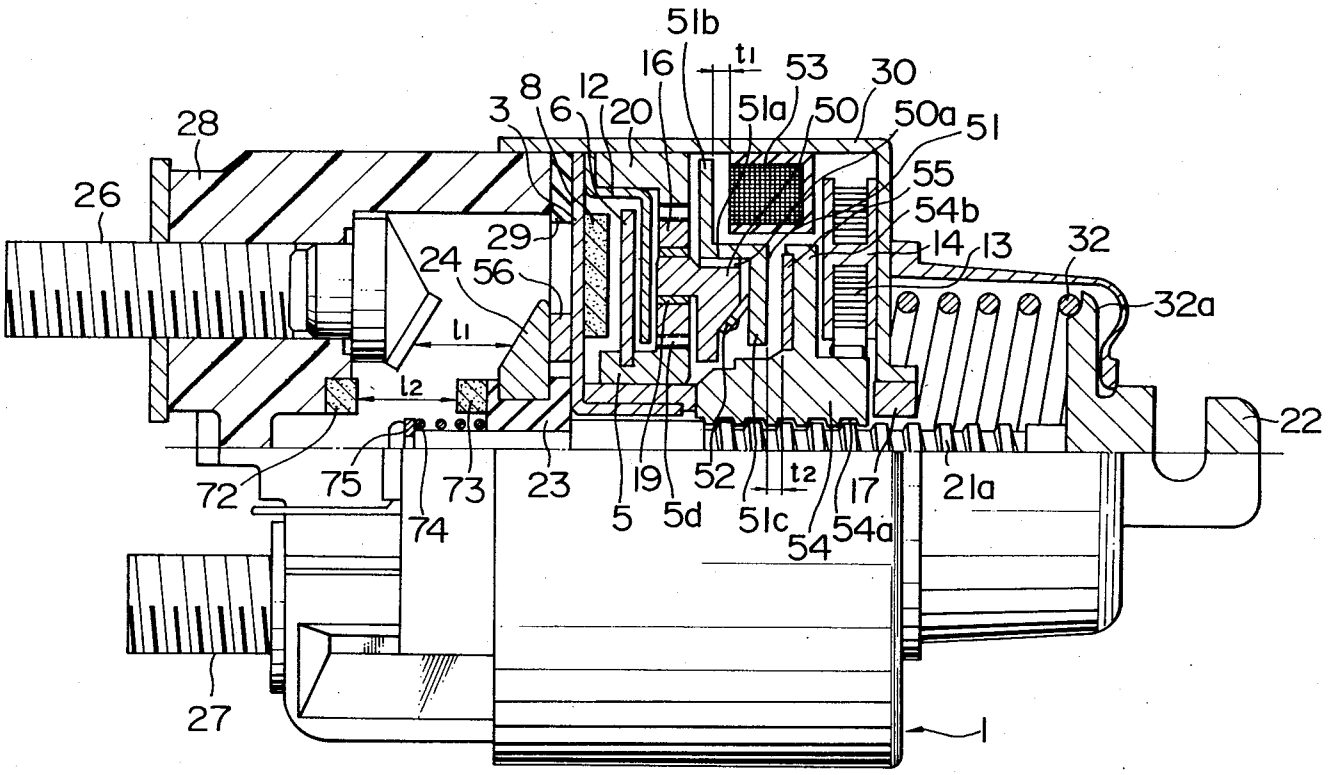

A third embodiment of the invention is shown in FIG. 7*a*. The present embodiment has a substantially identical arrangement to that of the second embodiment described above, while a first magnet 72 is provided on the inner side of a contact cover 28. Also, a second magnet 73 is provided on an insulator 23 which is for electrically insulating a movable contact 24 from a shaft 21. The second magnet 73 if fixed such as to confront the first magnet 72 with the confronting side of the magnet 73 being of a contrary magnetic pole to that of the magnet 72. In this third embodiment, the contact pressure spring 25 which is used in the above second embodiment is eliminated. In place of such a contact pressure spring, a spring 74 is interposed between the insulator 23 and a stopping washer 75 mounted on the distal end of the shaft 21 in a compressed condition. A distance $l_2$ between the first and the second magnets 72, 73 is set to be larger than a distance $l_1$ between the movable contact 24 and a fixed contact 26.

Subsequently, the operation of the third embodiment will be described. When the shaft 21 is moved by the actuation of a print motor through a driving body 54 and the movable contact 24 comes near the fixed contact 26, the first magnet 72 and the second magnet 73 also come close to each other. At the point that the attracting force between the first and the second magnets 72, 73 overcomes the set force of the spring 74, the movable contact 24 abuts on the fixed contact 26 abruptly at a speed higher than the movement speed of the shaft 21 and the contacts are thus closed as shown in FIG. 7*b*. In this state, a distance $l_3$ is defined between the first and the second magnets 72, 73. The magnetic attracting force between the first and the second magnets 72, 73 causes a contact pressure of the movable contact 24.

When a starter switch is set in OFF position, the energy stored in a power spring 13 is released and a driving body 54 is reversedly rotated to move the shaft 21 backwardly. In this case, the movable contact 24 is kept in contact with the fixed contacts 26 and 27 and maintained at the ON position thereof as long as the attracting force between the first and the second magnets 72, 73 is stronger than the force of the spring 74. Succeedingly, when the spring force of the spring 74 exceeds the attracting force of the magnets 72 and 73, the movable contact 24 is separated from the fixed contacts 26 and 27 at one rush and turned into the OFF position.

According to the above-described arrangement, the ON-OFF operation of the contacts can be carried out in a rapid manner and the contacts can be prevented from fusing.

In a fourth embodiment shown in FIG. 8, there is provided a contact pressure spring 25 as is in the embodiment shown in FIG. 6. In this embodiment, a movable contact 24 is arranged to be stationary by means of equilibrium of the spring forces of the contact pressure spring 25 and a spring 74. A distance $l_4$ between a cover 30 and a plate 32*a* is set to be smaller than a distance $l_1$ between the movable contact 24 and a fixed contact 26. By this setting, the axial movement of the shaft 21 is restrained by the abutment of the plate 32*a* on switch cover 30.

In a fifth embodiment shown in FIG. 9, in addition to the construction of the above-described third embodiment, an insulator 23 is so formed that a movable contact 24 can slide axially. There is also provided a spring 76 for absorbing a clearance between the insulator and the movable contact 24 on the outer periphery of the insulator 23. The spring 76 biases the movable contact 24 to the side of a fixed contact 26.

As the fifth embodiment is arranged in such a manner as described above, a distance $l_1$ is not necessary to be set shorter than a distance $l_2$ as is in the third embodiment. Even if the distance $l_2$ becomes shorter than the distance $l_1$, the movable contact 24 is to abut on the fixed contact 26 securely because of the yielding of the spring 76.

Further, although the first and second magnets 72 and 73 are used in the above-described third to fifth embodiments, either of them may be made of a magnetic material such as iron plate to be magnetized.

In a sixth embodiment shown in FIG. 10, a disc-like support body 80 supports planet gears 16 rotatably by means of projections 80*a* provided on the body 80. The support body 80 is rotatably mounted on the outer periphery of a first tube-like portion 3*a* of a first yoke 3 through a bearing.

On the other hand, a spiral groove 21*a* of a shaft 21 is fitted in a rotating body 81, and one end of a power spring 13 is secured to the outer peripheral portion of the rotating body 81 at one end thereof. Also, three concave portions 81*a* are formed at equal circumferential intervals in the outer peripheral portion of the rotating body 81 at the other thereof. Reference numeral 82 designates a disc-shaped main body of a clutch, which is provided rotatably on the outer periphery of the rotating body 81 through a bearing.

As shown in FIGS. 11*a* and 11*b* three arcuate concave portions 81*a* are formed circumferentially apart from one another in the clutch main body 82 on the outer peripheral side thereof. Also, a support pin 82*b* is provided projectingly toward the support body 80 at a position between one end of each concave portion 82*a* and the axis of the shaft 21.

Reference numeral 83 denotes clutch levers, as shown in FIGS. 11*a* and 11*b*, each of which is formed at its inner-side tip with a claw portion 83*a* for engaging with each concave portion 81*a* provided in the outer periphery of the rotating body 81, with a slot 83*b* at its center portion and with a hole 83*c* at the other end portion of the clutch lever, respectively. Each clutch lever 83 is attached to the clutch main body 82 rotatably about the support pin 82*b* by engaging the hole 83*c* with the support pin 82*b* of the clutch main body 82.

In addition, plate-like protrusions 80*b* each inserted into the respective arcuate concave portions 82*a* of the clutch main body 80 are provided on the support body 80 and pins 80*c* movably fitted in the respective slots 83*b* are also provided on the support body. Each of the pins 80*c* is located on an imaginary line connecting each protrusion 80*b* of the support body 80 and the axis of the shaft 21. A spring 84 is inserted between one end of each arcuate concave portion 82*a* of the clutch main body 82 and the protrusion 80*b* of the support body 80 which is inserted in the associated concave portion.

The operation of the sixth embodiment will be described hereinafter. In the case that an electric current is not supplied to the switch device 1, the support body 80 is stationary in the restrained condition by a speed reducing gear train. In contrast, as the clutch main body 82 is in the rotatable condition, it rotates by a biasing force of the spring 84 until the other ends of the concave portions 82*a* abuts on the respective protrusions 80*b* of the support body 80 so that the main body 82 is in a relative conditions to the support body 80 as shown in FIG. 11*a*.

When an electric current is applied to the switch device, the planet gears 16 are rotated by the driving of a print motor, and the rotation of the print motor is reduced in speed through the speed reducing gear train to be transmitted to the support body 80. At this stage, the clutch main body 82 still remains stationary, and as shown in FIG. 11, each protrusion 80*b* of the support body 80 yields the associated spring 84 as the support body 80 is rotated. Also, the pins 80*c* move circumferentially within the slots 83*b* of respective clutch levers 83. The movement of these pins 80*c* causes the distance between each pin 80*c* and the associated support pin 82*b* of the clutch main body 82 to be shortened. In conjunction with this, each clutch lever 83 is rotated for moving the claw portion 83 thereof toward the rotating body 81 as shown by an arrow in FIG. 11*b*. The claw portions 83*a* are finally fitted in the respective concave portions 81*a* of the rotating body 81. As a result, the rotation which has been reduced in speed can be transmitted from the support body 80 to the rotating body 81 through the clutch main body 82. The subsequent operation is identical with that of the foregoing embodiment, namely the shaft 21 moves axially through the rotational driving by the rotating body 81.

Incidentally, the clutch main body 82 is formed to be so weighty that it would not rotate simultaneously with the movement of the pins 80*c* as well as the pressing by the springs 84.

When a starter switch is switched to OFF so that the electric current to the device is shut off, the rotation of the print motor ceases and then, the clutch main body 82 rotates relatively to the support body 80 through the reactional force by the spring 84, which has been compressed to return to the position shown in FIG. 11*a*.

According to the rotational movement of the clutch main body 80, each pin 80*c* goes away from the associated support pin 82*b*, and the clutch levers 83 swing to disengage the claw portions 83*a* thereof from the respective concave portions 81*a* of the rotating body 81. Thus, the rotating body 81 is separated from the support body 80 so that only the support body 80 is rotated at a high speed by the force of a spring 13 and a pinion and a movable contact 24 rapidly return together with the shaft 21 to their initial positions. Therefore, the contacts is prevented from fusing.

According to a seventh embodiment shown in FIG. 12, similar to the first embodiment of FIG. 1, a rotating body 17 supports planet gears 16. However, as shown in detail in FIGS. 13*a* and 13*b*, there are formed on the inner periphery first and second stepped portions 17*c* and 17*d* each extending circumferentially. Also, reference numeral 85 designates a driving body having an inner screw section for engaging with a screw section 21*a* of a shaft 21. A flange portion 85*a* for fitting in the first stepped portion 17*c* of the rotating body 17 is formed on one end of the driying body.

Additionally, a spring 86 is provided on the inside of the rotating body 17 to surround the driving body 85. Retaining portions 86*a* and 86*b* extending oppositely in the axial direction of the spring are formed at both ends of the spring 86 as shown in FIG. 14. The retaining portion 86*a* is inserted into a hole 85*b* formed in the flange portion 85*a* of the driving body 85, and the retaining portion 86*b* is inserted into a hole 17*e* formed in the second stepped part 17*d* of the rotating body 17. Thus, the spring 86 is suspended between the driving body 85 and the rotating body 17.

The operation of the seventh embodiment will be described hereinafter. When an electric current is supplied to a device 1, an armature 6 of a print motor is rotated, and the rotation of the armature 6 is reduced in speed through the planet gears 16 to be transmitted to the rotating body 17. The spring 86 is distorted through the rotation of the rotating body 17 and expands in diameter outwardly as shown in FIG. 13*b*. The rotating body 17 races until the spring 86 abuts on the inner periphery of the rotating body 17.

When the spring 86 cannot extend any longer, the rotating force is transmitted from the rotating body 17 to the driving body 85 via the spring 86 so that the driving body 85 rotates for advancing the shaft 21.

Further, when the electric power supply to the switch device 1 is shut off, the print motor ceases its rotational movement and the rotating body 17 becomes difficult to rotate because it is connected to a speed reducing gear train through the planet gears 16. Accordingly, a spring force stored in the spring 86 causes the driving body 85 to rotate reversely, and the shaft 21 starts the return motion thereof rapidly. Then, the shaft 21 returns to its initial position by the force of inertia of the driving body 85 and the spring force of a return spring 32.

Incidentally, the number of windings of the spring 86 may be selected so as to obtain a recovery distance thereof larger than the relaxation necessary for disconnecting contacts, so that the disconnection of the movable contact 24 from the fixed contact 26 can be carried out rapidly.

In an eighth embodiment shown in FIG. 15, by rotating an armature 6 of a print motor clockwise or counterclockwise a shaft 21 of a switch device 1 is moved forwardly or backwardly, so that a power spring 13 provided in the embodiments described so far can be omitted. In FIG. 15, reference numeral 87 denotes a battery and 88 denotes a key switch. The key switch 88 comprises a movable member 91 and a pair of fixed contacts 89 and 90, which fixed contacts are respectively connected to the two pole terminals of the print motor. Further, first to third contacts 91*a* to 91*c* are provided on the movable member 91, the first and third contacts 91*a* and 91*c* are connected to the plus terminal of the battery 87 and the second contact 91*b* is connected to the minus terminal of the battery. And moreover, a spring 92 for returning the movable member is provided in the key switch 88.

Operation modes of the key switch 88 are shown in FIG. 16. The armature 6 of the print motor is rotated clockwise at ON-2 mode shown in FIG. 16(*c*), wherein the first contact 91*a* and the second contact 91*b* of the movable member 91 are respectively in contact with the fixed contacts 89 and 90. During ON-1 mode shown in FIG. 16(*b*), the polarity of an electric current supplied to two terminals of the print motor is reverse to that of the ON-2 mode so that the print motor rotates reversely.

When the key switch 88 is switched into OFF after starting of the engine, the movable member 91 moves by a spring force of the spring 92 to change from ON-2 mode (FIG. 16(*c*)) through ON-1 mode (FIG. 16(*b*)) to OFF mode (FIG. 16(*a*)). Accordingly, the first to third contacts of the movable member 91 slides on the fixed contacts 89 and 90. During the sliding of the contacts, since the key switch is in ON-1 mode for an instant, an electric power of reverse polarity is applied to the print motor to rotate the armature 6 reversely. As a result, the shaft 21 is returned to the position as it was by the spring force of the spring 32 and the contacts are opened.

Incidentally, a time duration of supplying electricity during ON-1 mode may be regulated by changing a spring constant of the spring 92 of the key switch 88. However, ON-1 mode is a mere mode which provides a start for returning the shaft 21 and the time duration of supplying electricity may be for a moment.

There is shown in FIG. 17 a starter system in which a switch device according to a ninth embodiment of the invention is incorporated. In FIG. 17, a key switch is designated by reference numeral 93. The present embodiment is so arranged that a print motor does not operate during actuation of a starter motor, and that the print motor is rotated reversely in succession to starting of an internal combustion engine.

In the operation of the ninth embodiment, when the key switch 93 is turned to ON, the voltage of a battery 87 is applied to the print motor 2 to rotate the same. Thus, through the displacement of a shaft of the switch device, a pinion of the starter engages with a ring gear of the internal combustion engine and a movable contact 24 also abuts on a pair of fixed contacts 26 and 27. Due to the connection of the contacts, the starter motor 33 is energized by the voltage of the battery 87 so as to rotate for starting the internal combustion engine. Simultaneously, as an earth-side electrode of the print motor 2 is connected to a power source side electrode of the starter motor 33, both electrodes of the print motor 2 becomes equivalent in electric potential so that the print motor stops rotating.

When the key switch 93 is turned to OFF after starting of the internal combustion engine, an electric current flows from the power source-side electrode of the starter motor 33 into other print motor 2 reversely to the flow direction of electric current in the aforesaid ON condition of the key switch 93, since a usually-closed contact 93*a* of the key switch is grounded. Thus the print motor 2 rotates reversely to make the pinion of the starter motor 33 return to the initial position thereof and to separate the movable contact 24 from the fixed contacts 26 and 27 so as to stop the rotation of the starter motor 33. Also in the switch device of the present embodiment, a return spring 32 is provided, so that the shaft of the switch device may return to the initial position thereof by means of the biasing of the return spring 32 even when the movable and fixed contacts are disconnected from each other by the reverse rotation of the print motor 2.

In the above-described mode that key switch 93 is in OFF, as shown in FIG. 17, during a period that the magnet type starter motor 33 races in the direction of arrow N after the disconnection of the movable contact 24 from the fixed contacts 26 and 27 (approximately for 1 to 5 seconds), the magnet type starter motor 33 generates electricity and an electric current flows into the print motor 2 in the direction shown by arrow I in FIG. 17. This electromotive force allows the print motor 2 to rotate reversely for a relatively long time and makes sure of the return actuation of the switch device.

In the present embodiment, the print motor 2 is also adapted to rotate reversely when the key switch 93 is in OFF, and the embodiment has an effect that the operation of the switch device when the same is turned to OFF can be carried out surely.

A tenth embodiment of the invention is shown in FIG. 18. The present embodiment is an example in which a conventional key switch 94 having a usually-closed contact alone is utilized. In the present embodiment, a switch 95 similar to the key switch 93 in the above-described ninth embodiment is employed for controlling electric power supply to a print motor 2, and the switch 95 is arranged to cooperate with the key switch 94. More specifically, when the key switch 94 is turned to ON, the switch 95 is also turned to ON so as to rotate the print motor clockwise, and when the key switch 94 is turned to OFF, the switch 95 is grounded to complete a circuit for applying the print motor 2 with a voltage having reverse polarity to that in the ON mode described above. The other operation than above is substantially the same as that of the foregoing ninth embodiment.

An iron plate may be attached to the armature in order to prevent rotation of the armature 6 during the stoppage in operation of the print motor 2. That is to say, according to the present embodiment, when a movable contact 24 comes into contact with fixed contacts 26 and 27 to commence the application of an electric current to a starter motor 33, the print motor 2 stops rotating. In this case, the armature 6 of the print motor 2 tends to move by such vibrations as resulted from the rotation of the starter motor 33, the starting of an internal combustion engine or the like. However, the iron plate provided on the armature 6 is attracted by a magnet 8 of the print motor 2 for preventing the rotation of the print motor. Moreover, when the key switch is in OFF, the rotation of the armature 6 by the vibration of the internal combustion engine may also be prevented in the same way.

It is preferable that the iron plate for being provided on the armature 6 of the print motor 2 is made of a silicon steel. Iron loss during the rotation of the print motor can be reduced by the utilization of this material.

A switch device according to an eleventh embodiment shown in FIG. 19 includes a motor case 100, which has a magnet 102 secured to the inner periphery of the case and supports an armature shaft 105 rotatably through ball bearings 107 at respective ends of the case. An armature 103 is fixedly secured on the shaft 105, and a brush 104 is so located as to contact with the armature 103 slidably. The brush 104 is suspendingly supported by a support plate 101*a* through a brush holder 104*a*, which plate is secured to the motor case 100. Also, a feeding line is connected to the brush 104 and extends outwardly of the motor case 100 through a waterproof rubber brush 101*b*.

A helical spline 105*a*, is formed in the inner peripheral surface the armature shaft 105, and engages with a helical spline 106*a* provided on a contact shaft 106 which is disposed coaxially with the shaft 105 to extend therethrough. The contact shaft 106 is supported by the motor case 100 via a bush 108. A return spring 109 is disposed between the contact shaft 106 and the motor case 100 to produce a force for returning the contact shaft 106 in the direction shown by arrow B in FIG. 19. A movable contact 24 is secured to one end of the contact shaft 106 through an insulator. On the other hand, fixed contacts 26 and 27 are secured to a resin molded switch cover 112 opposite to the movable contact 24. A lever 47 is engaged with the other end of the contact shaft 106. so that the shaft 106 is operatively connected to a pinion 44 through the lever 47, a drive spring 114 and an overrunning clutch 45. Further, the brush 104 is connected to a direct current power source 117 through the aforesaid feeding line and a starter switch 116. The fixed contact 26 is also connected to the direct current power source 117 and the other fixed contact 27 is connected to a starter motor 33.

The operation of the eleventh embodiment will be described hereinafter.

When the starter switch 116 is closed, an electric current is supplied from the direct current power source 117 through the brush 104 to the armature 103, and then the armature 103 rotates by field magnetism of the magnet 102. When the armature 103 rotates, as the helical spline 105*a* of the armature shaft 105 is engaged with the helical spline 106*a* of the contact shaft 106, the contact shaft 106 moves in the direction shown by arrow A in FIG. 19. Simultaneously, the overrunning clutch 45 is moved in a direction toward a ring gear (not shown) via the lever 47, and when the pinion 44 abuts on the ring gear the drive spring 114 is compressed by the driving of the lever 47. Also, the movable contact 24 on the end of the contact shaft 106 comes into contact with the contacts 26 and 27 to interconnect the same. At the same time, the starter motor 33 begins to rotate and the clutch 45 rotates to transmit the rotation of the starter motor to the ring gear, thus performing the operation of the starter. In this operation, the movable contact 24 is in abutting contact with the fixed contacts 26 and 27 at a certain contact pressure by a lock torque of the armature 103.

On the other hand, when the starter switch 116 is opened, the electric feeding to the armature 103 is ceased and the rotation power of the armature 103 is lost. Accordingly, the contact shaft 106 is returned by the force of the return spring 109 and the movable contact 24 is disconnected from the fixed contacts 26 and 27 to stop the starter motor 33., Simultaneously, the clutch 45 is also returned by means of the lever 47 and the operation of the starter is stopped.

A twelfth embodiment of the invention is shown in FIG. 20. The present embodiment has such an arrangement that a switch device for a starter is located coaxially with a clutch shaft of the latter. According to the embodiment, an armature shaft 123*c* is supported rotatably by a motor case 124*a* through ball bearings 124*b*. A magnet 124 is secured to the inside of the motor case 124*a* so as to encircle an armature 123, and a brush 122 is so located as to contact with the armature 123. The brush 122 is retained by a brush holder 122*a* and connected to a direct current power source 138 through a feeding line and a starter switch 121. A pinion shaft rod 125 and a contact rod 126 are disposed within the armature shaft 123*c*, which engages with these rods 125 and 126 through a helical spline 123*a* and 123*b* provided in the inner periphery of the armature shaft 123*c*, respectively. The helical splines 123*a* and 123*b* are formed such that the directions their helices are opposite to each other.

The pinion shaft rod 125 comprises a helical spline portion and a rod portion capable of extending and retracting relatively to the helical spline portion. The helical spline portion contains a drive spring 125*a* for biasing the rod portion so that it may protrude from the helical spline portion. The pinion shaft rod 125 is so located that the protruding end of the rod portion may thrust a pinion shaft 131 through a ball 130. On one hand, the contact rod 126 has a movable contact 127 mounted on its one end. Also, a pair of fixed contacts 127*a*, 127*a* are located opposite to the movable contact, and these fixed contacts are fixed on a switch cover 137 integrally therewith when the switch cover is molded. The switch cover is secured to the motor case 124*a*. Fixed contact 127*a* is connected to a starter motor 136 and the other contact is connected to the direct current power source 138. A return spring 128 is suspendingly mounted between the movable contact 127 and the switch cover 137.

An overrunning clutch 132 is rotatably supported by ball bearings 132*a*, and has a pinion 133 mounted on one end of the clutch. The clutch has a pinion shaft return spring 129 mounted in the clutch, and is connected to the pinion shaft 131 by means of the spring. There is formed on the outer periphery of the clutch 132 with a gear which transmits the rotation of the starter motor 136 to the pinion 133 through an idle gear 134 and an armature gear 135.

The operation of the present embodiment will be described. In case the starter switch 121 is closed, an electric power is supplied to rotate the armature 123 as well as the armature shaft 123*c*. As a result, the pinion shaft rod 125 moves in the direction shown by arrow C in FIG. 20 by the helical spline 123*a* in the shaft 123*c* for thrusting the pinion shaft 131. Simultaneously, the contact rod 126 moves in the direction shown by arrow D through the reverse helical spline 123*b*.

By the basing of the pinion shaft 131, the overrunning clutch 132 moves and the pinion 133 abuts on a ring gear on the internal combustion engine side (not shown). Then, the drive spring 125*a* contained in the pinion shaft rod 125 is compressed, and only the helical portion thereof further moves in the C-direction. At the same time, the fixed contacts 127*a*, 127*a* are connected by the movable contact 127 to rotate the starter motor 136. The rotational force of the starter motor is thus transmitted to the pinion 133 through the armature gear 135, the idle gear 134 and the clutch 132. Also, the biasing force of the aforesaid drive spring 125*a* serves to engage the pinion 133 with the ring gear, thus performing the operation of the starter.

In this operating condition, the movable contact 127 is biased against the contacts 127*a* by a lock torque of the armature 123.

On the other hand, when the starter switch 121 is opened, the electric feeding to the armature 123 is shut off and the armature 123 is not rotated thereof. Thus, the movable contact 127, and the pinion shaft 131 and the pinion shaft rod 125 are returned by means of the return spring 128 and the pinion shaft return spring 129 contained in the clutch 132, respectively, and then the starter stops in operation.

A thirteenth embodiment shown in FIG. 21 is a modification of the seventh embodiment shown in FIG. 12. In FIG. 21, the same numerals as used in FIG. 12 designate the same components.

In the present embodiment, a screw portion 21*a* is formed on a shaft 21 not to extend to a portion adjacent the end thereof, and this portion adjacent the end of the shaft 21 is formed into a taper section 21*d* of which diameter is increased progressively toward a hook portion 22 as shown in detail in FIG. 22.

Similarly to the above-described seventh embodiment, in the operation of the present embodiment, the rotational force of a print motor 2 is reduced in speed to be transmitted to a driving body 85 which in turn transmits the force to the shaft 21. The shaft 21 moves in the axial direction thereof and a movable contact 24 abuts on fixed contacts 26 and 27.

At this time, the inner periphery of the driving body 85 comes into contact with the taper section 21*d* of the shaft 21, and due to a frictional force between the driving body 85 and the taper section 21*d* the shaft 21 the movable contact 24 is brought into abutting engagement with the fixed contacts 26 and 27 under a certain contact pressure (by a contact pressure spring 25).

Therefore, even when the movable contact 24 abuts on the fixed contacts 26 and 27 so that the shaft 21 can not advance in the axial direction thereof any longer, the print motor 2 would not be fallen into a locked condition as the driving body 85 rotates on the taper section 21*d* of the shaft 21, and the consumption of electric current can be restrained small.

As has been described, according to present invention, the rotation of the rotating shaft of a motor is transmitted to a rotating body from which the rotation is in turn transmitted to another shaft to move the same in the axial direction thereof so as to move the pinion. Accordingly, in the starter switch device according to the present invention, the axial length of the device can be reduced because the motor is decreased in the axial length, and the radial length of the device may also be reduced because the diameter of the shaft can be reduced. Therefore, the device offers the advantage that the overall demension of the switch device can be decreased.

Having thus described the present invention on the basis of the preferred embodiments, it is to be understood that the invention is not limited solely thereto, but that various changes and modifications can be made within the scope of the appended claims.

What is claimed is:

1. A starter switch device for use with a starter motor for an internal combustion engine, said starter switch device comprising:

(a) contact means, including a fixed and a movable contact selectively in contact with said fixed contact, for controlling electric power supply to said starter motor;

(b) shaft means axially movable and having one end carrying said movable contact and an other end adapted for connection to a pinion of said starter motor for displacing said pinion;

(c) means for driving said shaft means including a rotating shaft and a driving body, said driving body engaging with said shaft means for moving said shaft means rectilinearly by rotation of said rotating shaft;

(d) one-way clutch means, provided between said rotating shaft and said driving body, for transmitting a driving force from said rotating shaft to said driving body; and (e) return means, connected to said driving body, for moving said shaft means back to a position whereat said movable contact is separated from said fixed contact to break a connection therebetween.

2. A starter switch device according to claim 1, wherein said driving means comprises a flat motor which is of an axially flat-shape, and said rotating shaft is disposed concentrically around an outer periphery of said shaft means.

3. A starter switch device according to claim 1, wherein said shaft means comprises a screw provided in an outer periphery of said shaft means for engagement with said driving body, said screw has a concave portion extending axially of said shaft means, a projection formed in a bearing for journalling said shaft means is fitted in said concave portion for permitting said shaft means to move in a rectilinear motion and preventing the shaft means from rotating.

4. A starter switch device according to claim 1, wherein said clutch means comprises an electromagnetic clutch operative simultaneously with the commencing of electric power flow to said starter switch device.

5. A starter switch device according to claim 1 wherein said clutch means comprises a mechanical clutch engeable with said driving body by means of a centrifugal force caused by rotation of said rotating shaft.

6. A starter switch device according to claim 1, wherein said clutch means comprises a coil spring suspended between said rotating shaft and said driving body, said coil spring being twisted by rotation of said rotating shaft to extend in diameter and firmly contact with said rotating shaft so that said rotating shaft is drivingly connected to said driving body through said coil spring.

7. A starter switch device according to claim 1, wherein said movable contact is slidable relative to said shaft means, and at least one of said fixed and movable contacts includes a magnet arranged to exert an attracting force between said fixed and movable contacts so that said movable contact abuts said fixed contact abruptly at a speed higher than movement speed of said shaft means and that disconnection of said movable contact from said fixed contract is carried out in a rapid manner when a returning force of said return means becomes larger than the attracting force by said magnet.

8. A starter switch device for use with a starter motor for an internal combustion engine, said starter switch device comprising:

(a) contact means, including a fixed and a movable contact selectively in contact with said fixed contact, for controlling electric power supply to said starter motor;

(b) shaft means axially movable and having one end carrying said movable contact and an other end adapted for connection to a pinion of said starter motor for displacing said pinion;

(c) means for driving said shaft means including a rotating shaft and a driving body, said driving body engaging with said shaft means for moving said shaft means rectilinearly by rotation of said rotating shaft;

(d) one-way clutch means, provided between said rotating shaft and said driving body, for tarnsmitting a driving force from said rotating shaft to said driving body;

(e) return means, connected to siad driving body, for moving said shaft means back to a position whereat said movable contact is separated from said fixed contact to break a connection therebetween; and (f) speed reduction means provided between said rotating shaft and said clutch means for reducing a speed of rotation of said rotating shaft.

9. A starter switch device according to claim 8, wherein said driving means comprises a flat motor of an axially flat-shape, and said speed reduction means comprises a planetary gear mechanism which includes planetary gears arranged coaxially with said flat motor.

10. A starter switch device according to claim 8, wherein said movable contact is slidable relative to said shaft means, and at least one of said fixed and movable contacts includes a magnet arranged to exert an attracting force between said fixed contact and said movable contact so that said movable contact abuts said fixed contact abruptly at a speed higher than movement speed of said shaft means and that disconnection of said movable contact from said fixed contact is carried out in a rapid manner when a returning force of said return means becomes larger than the attracting force of said magnet.

* * * * *